United States Patent [19]

Le Gall

[11] Patent Number: 4,920,349

[45] Date of Patent: Apr. 24, 1990

[54] ANTENNA MOUNTING WITH PASSIVE STABILIZATION

[75] Inventor: Jean C. Le Gall, Perros Guirec, France

[73] Assignee: Centre National d'Etudes des Telecommunications, France

[21] Appl. No.: 634,582

[22] Filed: Jul. 26, 1984

[30] Foreign Application Priority Data

Aug. 3, 1983 [FR] France ..... 83 12821

[51] Int. Cl.[5] ..... H01Q 1/34

[52] U.S. Cl. ..... 343/709

[58] Field of Search ..... 343/709, 765

[56] References Cited

U.S. PATENT DOCUMENTS

| | | | |
|---|---|---|---|
| 3,860,931 | 1/1975 | Pope et al. | 343/709 |
| 3,968,496 | 7/1976 | Brunvoll | 343/765 |
| 3,999,184 | 12/1976 | Fuss | 343/709 |
| 4,020,491 | 4/1977 | Bieser et al. | 343/765 |
| 4,197,548 | 4/1980 | Smith et al. | 343/765 |
| 4,442,435 | 4/1984 | Kiryu et al. | 343/709 |
| 4,582,291 | 4/1986 | Matthews | 343/765 |
| 4,596,989 | 6/1986 | Smith et al. | 343/709 |
| 4,609,083 | 9/1986 | Stuhler | 343/709 |

FOREIGN PATENT DOCUMENTS 52-2362 10/1977 Japan ..... 343/709

*Primary Examiner*—William L. Sikes
*Assistant Examiner*—Robert E. Wise
*Attorney, Agent, or Firm*—Larson & Taylor

[57] ABSTRACT

An antenna mounting for use on a ship and which can be oriented in bearing and in elevation and has passive stabilization, which antenna mounting comprises, in combination,: (a) a frame which can be attached to a ship; (b) a support which can be oriented in bearing around an axis (bearing axis) in relation to said frame; (c) an intermediate device which is mounted on said support to oscillate around an intermediate axis at right angles to said bearing axis and whose center of gravity is below such intermediate axis; (d) an antenna support mounted on said device and which can be oriented around an axis of elevation at right angles to said intermediate axis; and (e) means comprising a pendular body mechanically connected to said support and said intermediate device and acting therebetween to maintain said intermediate device in a required orientation relative to horizontal.

12 Claims, 5 Drawing Sheets

ANTENNA MOUNTING WITH PASSIVE STABILIZATION

The invention relates to an antenna mounting for a ship which enables the orientation of the antenna to be stablized when the vessel makes oscillatory, more particularly rolling movements.

An antenna intended to ensure communication between vessel and satellite must have a high gain. However, to obtain a high gain there must be a small beam opening, so that the extent to which the antenna axis can be allowed to oscillate around its theoretical orientation is more limited in proportion as the gain is higher. However, a vessel at sea, more particularly one of low tonnage, is almost always making the oscillatory movements of rolling and pitching and, if their amplitude exceeds the lobe width of the antenna, the latter must be stablized.

It has already been suggested that an antenna should be stabilized using an active system comprising gyroscopes and servocontrol loops, but that solution is expensive. It has also been suggested that passive stabilization of the antenna might be achieved by the provision of a counterweight, so that the centre of gravity of the oscillating structure was a very small distance below the centre of oscillation, and therefore the specific period of the resulting assembly would be much greater than the periods of oscillation during rolling and pitching. However, this approach makes the antenna extremely sensitive to the least inbalance due to the absence of rigidity of the system, and it remains ineffective in face of disturbing torques. It can therefore hardly be used in the conditions of operation at sea.

It is an object of the invention to provide a ship's antenna mounting which satisfies practical requirements better than the previous art, more particularly in requiring only the addition of very simple passive means to the means which are in any needed to modify the orientation of the antenna in relation to the vessel as a function of its course.

Before defining the invention, it may be useful to recall the accelerations to which a vessel at sea is subject. To simplify things, we shall first suppose the vessel is subjected exclusively to rolling movements, accelerations due to pitching, yawing and buffeting being negligible in comparison with those caused by rolling. In any case, this hypothesis is frequently the fact.

Figure 1:
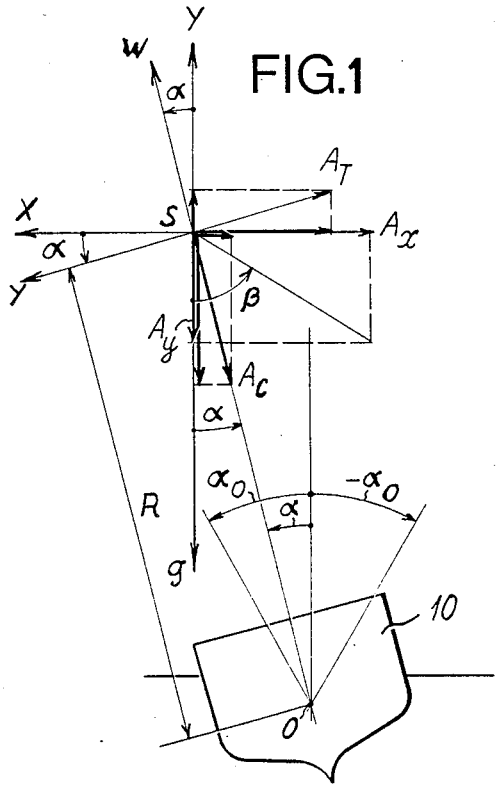

FIG. 1 shows diagrammatically, in cross section, the hull 10 of a vessel subjected to a rolling movement around a centre O. The angular displacement $\alpha$ therefore takes the shape $\alpha=\alpha_o \sin \omega t$. It is expressed by an angular acceleration $\alpha''=-\alpha_o\omega^2 \sin \omega t=-\alpha\omega^2$. The horizontal and vertical axes in a plane transverse to a vessel, from the centre of oscillation of the antenna lying, for example, at the mast head, will be denoted by SX and SY. A simple calculation then shows that if we denote the acceleration due to gravity by g and the distance SO by R, the horizontal acceleration Ax and the vertical acceleration Ay will take the form:

$$\vec{Ax} = \begin{Bmatrix} -R\,\omega^2\,(\alpha_0 \mathrm{Sin}\,\omega t)\cdot\cos(\alpha_0 \mathrm{Sin}\,\omega t) \\ -R\,\omega^2\,\alpha_0^2\cos^2\omega t\cdot\sin(\alpha_0 \mathrm{Sin}\,\omega t) \end{Bmatrix}\vec{x}$$

-continued $$\vec{Ay} = \begin{Bmatrix} -g + R\omega^2\,(\alpha_0 \sin \omega t)\cdot \mathrm{Sin}\,(\alpha_0 \mathrm{Sin}\,\omega t) \\ -R\omega^2\,\alpha_0^2\cos^2\omega t\cdot\cos(\alpha_0 \sin \omega t) \end{Bmatrix}\vec{y}$$

From this we can deduce the total acceleration A and the angle which $\vec{A}$ makes with the true vertical $$\beta = \mathrm{Arc}\ tg\,\frac{Ax}{Ay}$$

Figure 2:
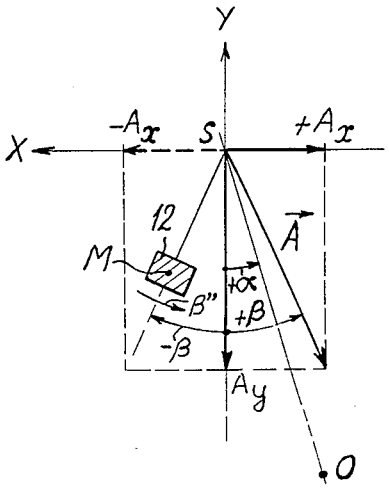

The invention makes use of the face that a pendulum 12 mounted to oscillate around an axis parallel with the rolling axis will adopt a movement such that it indicates an apparent vertical forming an axis $-\beta$ with the true vertical, its angular acceleration $\beta''$ being in the opposite direction from $\alpha$ (FIG. 2).

The invention therefore provides a ship's triaxial antenna mounting which can be oriented in bearing and in elevation and has passive stabilization, which comprises a support which can be oriented around a bearing axis in relation to a frame attached to the vessel, a device which is mounted to oscillate around an intermediate axis at right angles to the bearing axis and whose centre of gravity is below such intermediate axis, and an antenna support which can be oriented around an axis of elevation at right angles to the intermediate axis, characterized in that the intermediate device is connected to the support via means for restoring it to a predetermined position in relation to the support, comprising a pendular body for indicating the apparent vertical.

The passive stabilization can be achieved by compensating the torques brought into play by the rolling and pitching of the vessel, by connecting the pendulum to the intermediate device via a spring, or by compensating the speeds induced by the movement of the ship, by connecting the pendulum to the intermediate device mechanically via a train of gears, which will generally be a step-down epicyclic gear train.

Figure 4:
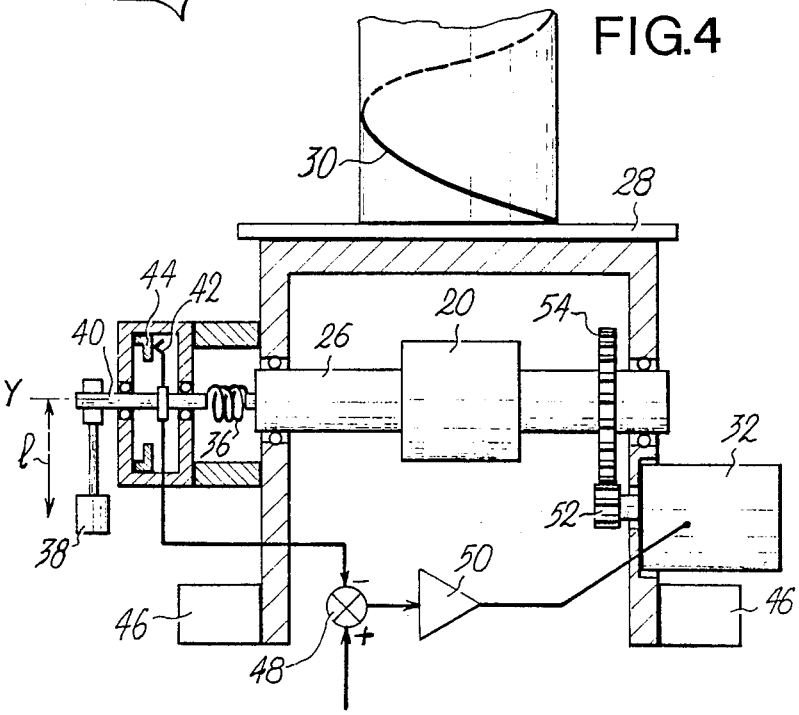
Figure 3:
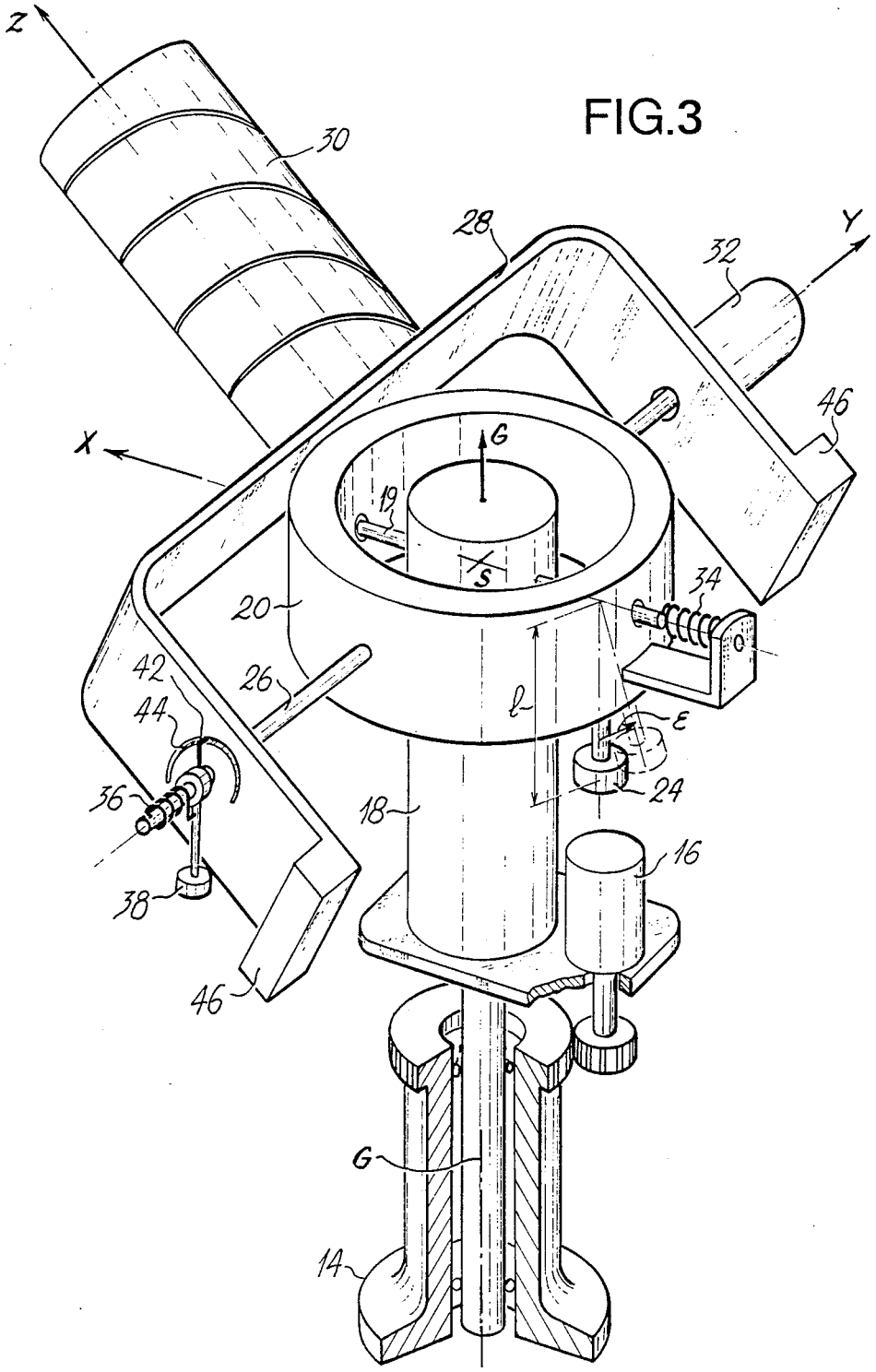
Figure 5:
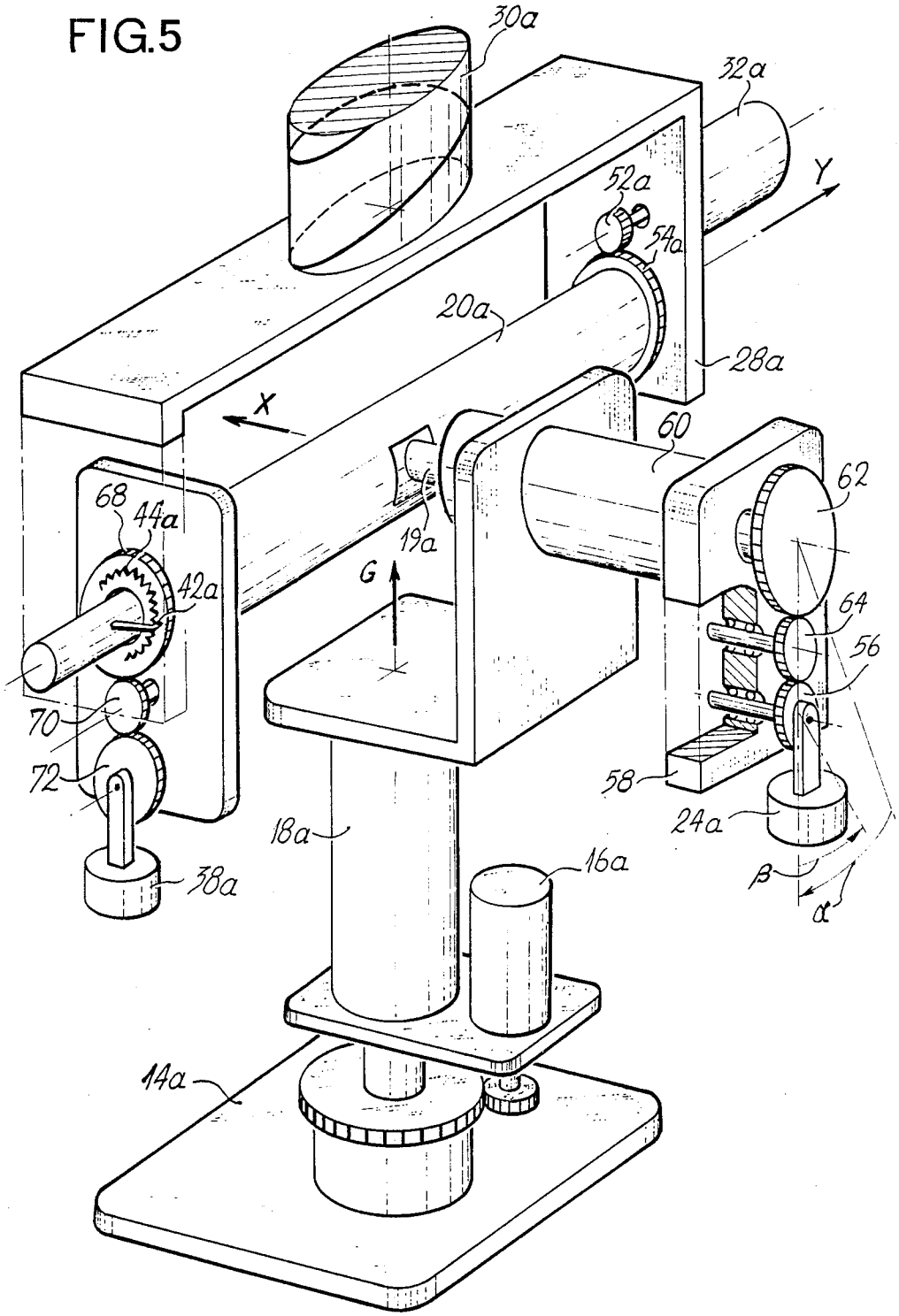
Figure 6:
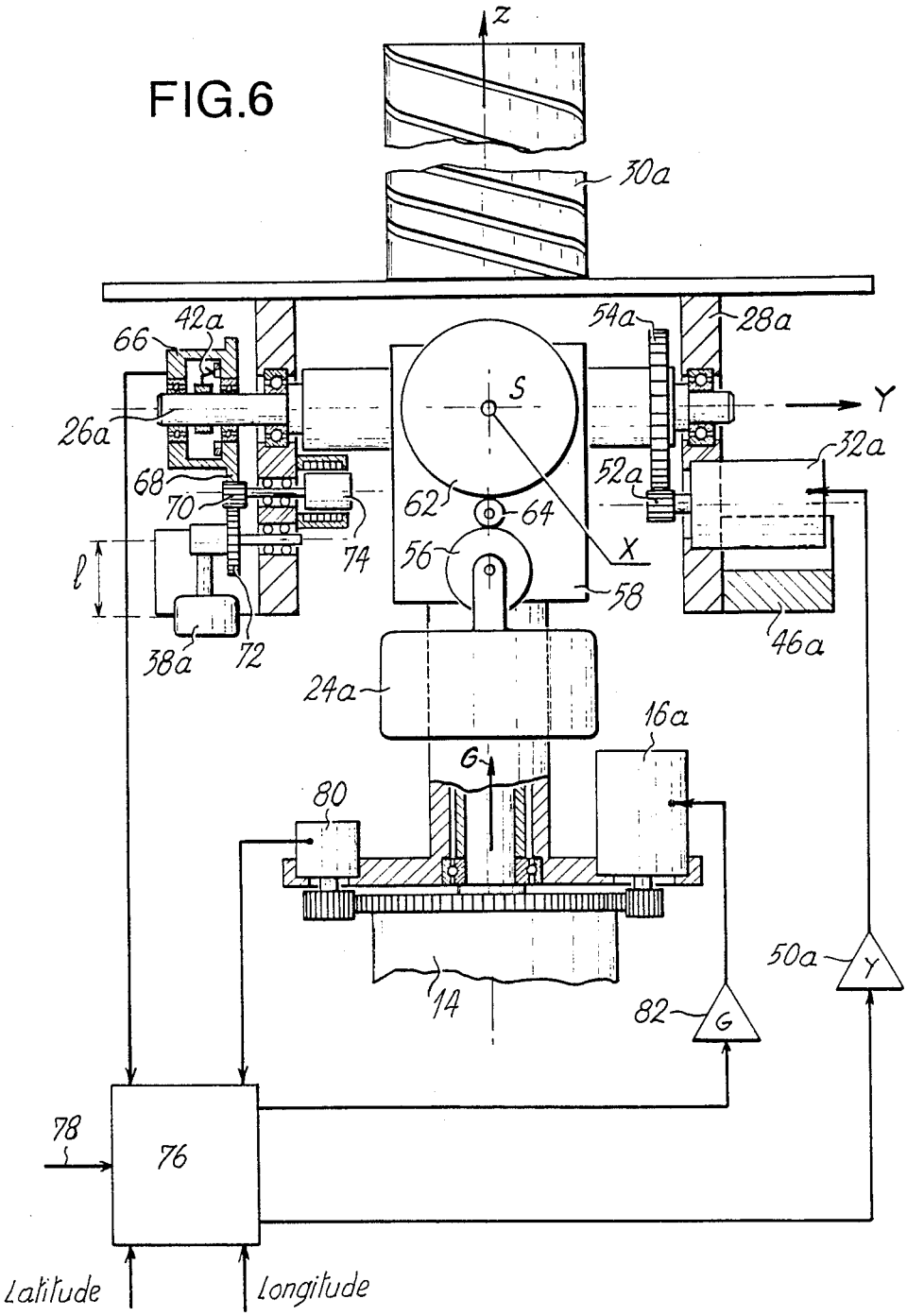
Figure 7:
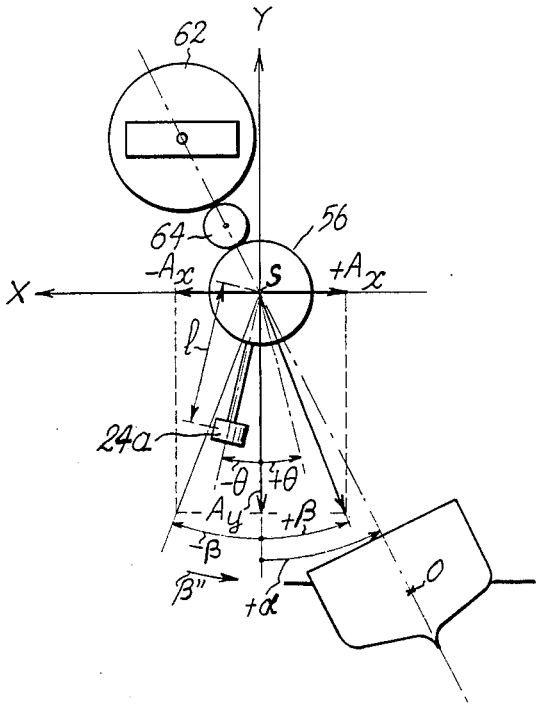
Figure 8:
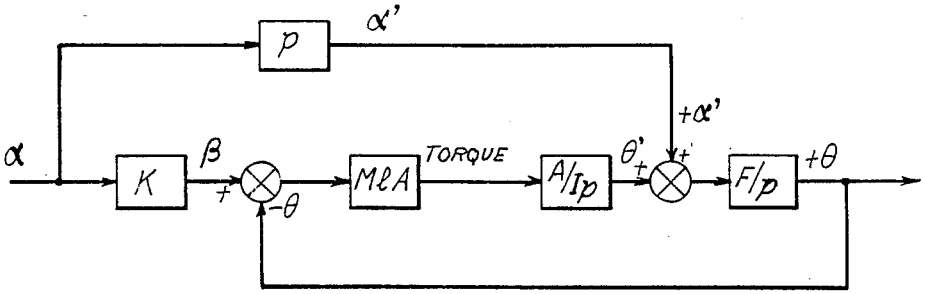

The invention will be more clearly understood from the following description of particular non-limitative exemplary embodiments thereof, with reference to the accompanying drawings, wherein:

FIG. 1, already mentioned, is a diagram illustrating the displacements and accelerations which occur in a plane transverse to the longitudinal axis of a rolling vessel, FIG. 2 is a diagram, in a plane transverse in relation to the vessel of FIG. 1, showing the various components of acceleration (horizontal acceleration Ax, vertical acceleration Ay according to the true vertical), FIG. 3 is a simplified perspective view showing a first embodiment of an antenna mounting according to the invention, with torque compensation, FIG. 4 is a basic diagram showing the way in which stabilization and aiming are carried out around the axis of the location of the mounting shown in FIG. 3, FIG. 5, which is similar to FIG. 3, shows a variant embodiment of the invention, in which stabilization is performed by movement compensation, FIG. 6 is a diagrammatic partially sectioned elevation of a possible embodiment of the arrangement shown in FIG. 5, FIG. 7 is a diagram showing the parameters entering into the operation of the device shown in FIGS. 5 and 6, and FIG. 8 is a graph illustrating the transfer function of the device shown in FIG. 7.

The antenna mounting shiown in FIG. 3 comprises a frame 14 which carries, via bearings defining an axis G of bearing orientation, a support 18. A servomotor 16, generally comprising an electric stepping motor, connects the base and the support and enables the latter to be oriented around the axis G.

Attached to the support 18 is a shaft 19 defining an orientational axis SX, at right angles to the axis G, of an intermediate device borne by the shaft via bearings. In the embodiment illustrated in FIG. 3 the device is reduced to a ring 20 adapted to be stabilized around the axis SX. Fixed to the ring 20 are two inertia blocks 24 which form a pendular body and are disposed in a plane which extends through the axis G when the bearing axis is vertical. The ring also carries a shaft 26, forming an axis SY of orientation in elevation.

Lastly, the shaft 26 carries, also via bearing, the stirrup 28 of an antenna support. The antenna 30 (a helical antenna, for example) is mounted on the stirrup with its radio-electric axis SZ perpendicular to the axis SY. A servomotor 32, similar to the servomotor 16, connects the stirrup 28 and the shaft 26, and enables the antenna to be oriented in elevation. As will be shown hereinafter, the servomotor 16 is so controlled that in the absence of rolling, the plane GSX contains the satellite at which the antenna 30 is to be aimed.

The antenna mounting is stabilized around the axis SX by torque compensation, so that the plane GSX contains the satellite in the absence of rolling, by connecting the shaft 19 to an angle plate connected to the ring 20 via a spring 34 of suitable stiffness. If we denote the stiffness of the spring by K, the angle through which the support 18 connected to the vessel turns by $\alpha$, and the deviation of the ring 20 from the vertical by $\epsilon$, we can see that the ring is subjected to:

a torque $C1=MlR\ \omega^2 \cos \omega t$ (notation as in FIGS. 1 and 2) due to the pendular body 24, a torque $C2=K(\alpha-\epsilon)$, due to the action of the rolling movement through the spring 34.

By applying the sum of these torques to the inertia $I_o$ of the assembly to be stabilized, we obtain a differential equation of the second degree, which we can integrate to determine the angular frequency of the stabilized assembly, which is equal to $\sqrt{K/I_o}$ when the system has no shock absorption. The angular frequency can be made much higher that the excitation frequency $\omega$.

We can also determine the transfer function. However, since the assembly to be stabilized is subjected to the opposite torques C1 and C2, we can see at once that $\epsilon$ can be minimized for a value of K such that $C1=C2$ for $\epsilon=0$. The mounting can clearly be given means enabling the stiffness K of the spring 34 to be modified.

The device for elevational stabilization is slightly differently constituted from the compensation device around the axis SX, since it must be combined with servocontrol of the elevational position. For this reason, in the arrangement shown in FIG. 4, it is connected via a spring 36, which performs the same function as the spring 34 in FIG. 3, to a rotary rod connected to the pendular body 38 and rotating in roller bearings borne by the stirrup. The rod 40 of the pendular body 38 carries the slider 42 of a potentiometer whose conductive track 44 is connected fast to the stirrup. Counterweights 46 will generally be provided on the latter to counterbalance the weight of the antenna 30. The output signal supplied by the slider 40 is applied to a subtracting circuit 48 whose second input receives a required elevation signal worked out by a computer connected to the vessel's navigation centre. The difference signal is applied to a processing circuit 50 comprising an amplifier which controls step by step the reduction motor 32 carried by the stirrup. The output pinion 52 of the reduction motor is connected to a pinion 54 attached to the shaft 26, so as to control the elevation of the antenna.

A simulation of the conditions of stabilization by such an antenna device borne by a typical vessel of 25,000 tonnes, in which the antenna 30 was located in the plane of rolling, showed that the amplitude of the angular error $\epsilon$ could be reduced to a value lower than 6° for rolling of ±28° on each side with a period of 12 seconds.

In the embodiment of the invention illustrated in FIGS. 5 and 6, in which like elements to those in FIGS. 3 and 4 are denoted by like references plus the index a, each of the compensating inertia blocks **24*a* and 38*a* comprises an epicyclic gear train (whose torque is zero, since the inertia block follows the oscillating direction of the apparent vertical $-\beta$) to the corresponding platform—i.e., the shaft 19*a* in the case of the pendular body 24*a*, and the potentiometer of the servocontrol loop of the elevation motor 32*a* in the case of the pendular body 38*a***.

In the embodiment illustrated in FIGS. 5 and 6 the reduction ratio between the pendular body **24*a* and the shaft 19*a* is positive. For this purpose the inertia block is connected fast to a first pinion 56 which rotates in a satellite support 58 attached to the support 18, and consequently to the vessel, via a sleeve 60, the pinion 56 being connected to a pinion 62 connected fast to the shaft 19*a* via a reply pinion 64 which also rotates in the satellite support 58. When in this case the satellite supportconnected to the vessel rotates through $\alpha$ in relation to the true vertical (FIG. 5), the wheel 56 connected to the pendular body 24*a* rotates through $-\beta$. The step-down ratio is optimized, so that the platform remains fixed or its amplitude of error is very low. This ratio therefore depends on the amplitudes of $\alpha$ and $\beta$, and compensation is possible, as will be seen hereinafter. Other arrangements also enable compensation to be effected. This is particularly the case when a positive step-down ratio is again used, but with the pinion 56 fixed to the support 18*a* and the wheel 62 connected to the platform, the wheel 64 still being carried by the satellite support 58. In contrast, it would be impossible to use a mounting with a positive step-down ratio in a case in which the satellite support 58 was attached to the intermediate device 20*a*, the wheel 56 had the pendular body 24*a*, and the relay pinion 64 was connected to the support 18*a*** connected to the vessel.

Conversely, if the relay pinion 64 is eliminated—i.e., a negative step-down ratio is used—, the only possible solution is the one which must be discarded in the case of a positive step-down ratio—i.e., the one in which the pinion 62 is connected to the vessel, the wheel 56 is connected to the pendular body **24*a*, and the satellite support in which the pinions rotate is connected to the intermediate device 20*a***.

As in the case of the first embodiment disclosed, it is possible to determine the transfer function relating to the displacement of the assembly to be stabilized. With the notation as indicated in FIG. 7, we determine the transfer function is as follows (p denoting the Laplace operator in conventional manner), the assembly to be stabilized, the force of inertia $I_o$, being supposed to be attached to the wheel 62, as in the case of FIG. 5):

$$\frac{\theta}{\alpha} = \frac{K\left(1 + \frac{f}{MlAK}\rho\right)}{\frac{1}{MlA}\rho^2 + \frac{f}{MlA}\rho + 1}$$

This transfer function gives the value of $\theta$, opposite to the position of the wheel 56, as a function of $\alpha$. f indicates a further shock-absorbing coefficient proportional to the speed which can be introduced at the level of the relay pinion.

The transfer function can be represented by the graph shown in FIG. 8 in which $\alpha$ denotes the angle of rolling and $-\theta$ the angular position of the pendulum.

Referring to FIG. 5 again, compensation around the axis Y and elevational servocontrol can be combined in the same way as in FIGS. 3 and 4, by means of a potentiometer whose slider 42*a* is connected to the shaft 20*a*, while the track is connected to a casing 66 having a toothed wheel 68 connected via a relay pinion 70 to a pinion 72 connected fast to the pendular body 38*a*. FIG. 6 shows an eddy current shock absorber 74 borne by the spindle of the relay pinion 70. Clearly, the arrangement illustrated may be modified, more particularly, the arrangement of the potentiometer elements might be reversed, and the shock absorber disposed on another pinion.

Finally, for the sake of completeness, FIG. 6 shows a computer 76 for working out all the control signals for the motors 16*a* and 32*a*. To this end the computer receives at an input 78 a signal representing the vessel's course as supplied by the gyrocompass. The latitude and longitude are displayed on extra inputs or supplied directly by a navigation centre. On the basis of these indications the computer 16 works out the required values of bearing and orientation around the axis Y. The bearing error is determined from the signal supplied by a pick-up 80 and the corresponding correctional signal delivered via an amplifier 82 to the reduction motor 16*a*. Similarly, the control for Y is worked out from the signal supplied by the potentiometer connecting the casing 66 and the shaft 26*a*, then applied to the step-down motor 32*a* via the amplifier 50*a*.

I claim:

1. For use on a ship, an antenna mounting system with controlled movement about bearing and elevation axes and passive stabilization about a transverse axis orthogonal to the bearing and elevation axis, comprising:

(a) a stationary stand;

(b) gimbal suspension means having: a gimbal support pivotally connected to said stand for rotation thereon about a bearing axis; an intermediate unit mounted on said gimbal support for oscillating movement thereon about a transverse axis at right angles to said bearing axis and having a center of gravity below said transverse axis; and an antenna support pivotally mounted on said intermediate unit for rotation thereon about an elevation axis at right angles to said intermediate axis;

(c) gravity responsive return means operatively connecting said intermediate unit and said gimbal support and arranged for retaining said intermediate unit into a predetermined direction relative to horizontal, said return means including: a pendular body pivotally connected to said gimble support about an axis parallel to said transverse axis for indicating an apparent vertical direction; and a gear train operatively connecting said intermediate unit and pendular body, said gear train being arranged so that any angular deviation of the intermediate unit from a predetermined set direction causes deviation of the angular body from said vertical position in the same angular direction.

2. An antenna mounting system according to claim 1, further including:

(d) a second pendular body mechanically connected to said intermediate unit and said antenna support for angular movement responsive to relative angular movement of said antenna support and intermediate unit;

(e) sensor means arranged to provide, in use, a signal indicative of the position of said second pendular body relative to said antenna support; and (f) servocontrol means responsive to said signal to maintain said antenna support in a required orientation.

3. An antenna mounting according to claim 2, wherein said second pendular body is carried by a rod mounted to oscillate around the axis of elevational orientation, said rod being connected to one of the elements of the sensor means, whose other element is attached to said antenna support.

4. An antenna mounting according to claim 2, including a train of gears disposed between said second pendular body and one of the elements of said sensor means, said other element of said pick-up being rotatably connected to said intermediate device.

5. An antenna mounting according to claim 4, wherein said train of gears is mounted on said support.

6. An antenna mounting according to claim 4, wherein said train of gears is provided with shock absorbing means.

7. For use on a ship, an antenna mounting system with passive stabilization and controlled movement about bearing and elevation axes, comprising:

(a) a stationary stand;

(b) gimbal suspension means having: a gimbal support pivotally connected to said stand for rotation thereon about a bearing axis; an intermediate unit mounted on said gimbal support for oscillating movement thereon about an intermediate axis at right angles to said bearing axis and having a center of gravity below said intermediate axis; and an antenna support pivotally mounted on said intermediate unit for rotation thereon about an elevation axis at right angles to said intermediate axis;

(c) gravity responsive return means operatively connecting said intermediate unit and said gimbal support and arranged for biasing said intermediate unit to a predetermined direction relative to horizontal, said return means including a first pendular body for indicating an apparent vertical direction; and (d) servomotor means operative for controlling the relative angular position of said antenna support about said elevation axis relative to said intermediate unit;

(e) a second pendular body pivotally connected to said antenna support for oscillating movement about the direction of said elevation axis responsive to changes in said angular position of said antenna support, (f) sensor means co-operating with said second pendular body and antenna support for providing an output signal indicative of the relative position of said pendular body relative to said antenna support; and (g) servocontrol circuit means responsive to said output signal and arranged for delivering control signals to said servomotor for maintaining said antenna support in a predetermined orientation.

8. For use on a ship, an antenna mounting system with passive stabilization system and controlled movement about bearing and elevation axis, comprising:

(a) a stationary stand;

(b) gimbal suspension means having: a gimbal support pivotally connected to said stand for rotation thereon about a bearing axis; an intermediate unit mounted on said gimbal support for oscillating movement thereon about an intermediate axis at right angles to said bearing axis and having a center of gravity below said intermediate axis; and an antenna support pivotally mounted on said intermediate unit for rotation thereon about an elevation axis at right angles to said intermediate axis, said antenna including an antenna having a radioelectrical axis perpendicular to the elevation axis and being provided with counterweights for substantial mechanical balance about said elevation axis;

(c) gravity responsive return means operatively connecting said intermediate unit and said gimbal support and arranged for biasing said intermediate unit to a predetermined direction relative to horizontal, said return means including a first pendular body for indicating an apparent vertical direction; and (d) first servomotor means operative for controlling the relative angular position of said antenna support about said elevation axis relative to said intermediate unit and second servomotor means operatively connecting said stand and gimbal support for controlling the angular position of said gimbal support about the bearing axis.

9. A system according to claim 8, further including:

(e) a second pendular body pivotally connected to said antenna support for oscillating movement about the direction of said elevation axis responsive to changes in said angular position of said antenna support, (f) sensor means co-operating with said second pendular body and antenna support for providing an output signal indicative of the relative position of said pendular body relative to said antenna support; and (g) servocontrol circuit means responsive to said output signal and arranged for delivering control signals to said servomotor for maintaining said antenna support in a predetermined orientation.

10. A system according to claim 9, wherein said second pendular body is pivotally supported by said antenna support for rotation thereon about said elevation axis and is connected to said intermediate unit by return spring means opposing relative angular deviation of said second pendular body and intermediate unit from a predetermined position.

11. For use on a ship, an antenna mounting system with controlled movement about bearing and elevation axes, and passive stabilization about a intermediate axis orthogonal to the bearing and elevation axis, comprising:

(a) a stationary stand;

(b9 gimbal suspension means having: a gimbal support pivotally connected to said stand for rotation thereon about a bearing axis; an intermediate unit mounted on said gimbal support for oscillating movement thereon about an intermediate axis at right angles to said bearing axis and having a center of gravity below said intermediate axis; and an antenna support pivotally mounted on said intermediate unit for rotation thereon about an elevation axis at right angles to said intermediate axis; said intermediate unit having a ring pivotally supporting said antenna support and additional angular bodies secured to said ring, projecting downwardly from said ring in a direction orthogonal to said intermediate axis and elevation axis located substantially in a plane passing through said intermediate axis;

(c) gravity responsive return means operatively connecting said intermediary unit and said gimbal support and arranged for biasing said intermediate unit to a predetermined direction relative to horizontal, said return means including a second pendular body rotatable about said axis; and (d) spring means operatively connecting said ring and gimbal support for opposing relative movement thereof from a predetermined position, whereby stabilization about said intermediate axis occurs due to torque compensation upon oscillatory movement of said stationary stand.

12. For use on a ship, an antenna mounting system with controlled movement about bearing and elevation axes and passive stabilization about a transverse axis orthogonal to the bearing and elevation axes, comprising:

(a) a stationary stand;

(b) gimbal suspension means having: a gimbal support pivotally connected to said stand for rotation thereon about a bearing axis; an intermediate unit mounted on said gimbal support for oscillating movement thereon about a transverse axis at right angles to said bearing axis and having a center of gravity below said transverse axis; and an antenna support pivotally mounted on said intermediate unit for rotation thereon about an elevation axis at right angles to said intermediate axis;

(c) gravity responsive return means operatively connecting said intermediate unit and said gimbal support and arranged for retaining said intermediate unit into a predetermined direction relative to horizontal, said return means including: a pendular body pivotally connected to said gimbal support about an axis parallel to said transverse axis for indicating an apparent vertical direction; and a gear train operatively connecting said intermediate unit and pendular body, said gear train being arranged so that any deviation of the intermediate unit from a predetermined set direction causes angular deviation of the pendular body from said vertical position in the same angular direction, wherein said train of gears comprises a pinion connected fast to said intermediate device for rotation therewith, a pinion journalled in said support and connected fast to said pendular body for rotation therewith, and a relay pinion which meshes with the other pinions and is also journalled in said support.

* * * * *